United States Patent [19]

Laico et al.

[11] Patent Number: 4,964,400

[45] Date of Patent: Oct. 23, 1990

[54] SURGICAL LIMB SUPPORTING APPARATUS WITH TENSION MEASURING DEVICE

[75] Inventors: Joseph P. Laico, New City; Joseph L. Molino, Valley Cottage, both of N.Y.

[73] Assignee: Lincoln Mills, Inc., New City, N.Y.

[21] Appl. No.: 318,811

[22] Filed: Mar. 3, 1989

Related U.S. Application Data

[63] Continuation-in-part of Ser. No. 183,636, Apr. 19, 1988, abandoned.

[51] Int. Cl.[5] ..... A61G 13/00

[52] U.S. Cl. ..... 128/75; 128/77; 128/84 C; 128/878

[58] Field of Search ..... 128/878, 84 C, 87 R, 128/77, 80 R, 877, 879, 85, 882, 80 A, 75, 84 R, 84 B, 87 C; 5/445

[56] References Cited

U.S. PATENT DOCUMENTS

| | | | |
|---|---|---|---|
| 198,723 | 12/1877 | Woods | 128/84 R |
| 1,699,026 | 1/1929 | Schumacher | 128/84 C |
| 2,020,262 | 11/1935 | Longfellow | 128/84 B |
| 2,302,868 | 11/1942 | Invidiato | 128/87 R |
| 3,662,750 | 5/1972 | Jorgensen | 128/84 C |
| 3,765,411 | 10/1973 | Ward | 128/84 C |
| 3,800,787 | 4/1974 | Rush | 128/84 R |
| 3,850,165 | 11/1974 | Throner | 128/84 C |
| 4,181,125 | 1/1980 | Carlson | 128/75 |
| 4,254,766 | 3/1981 | Kordis | 128/87 R |
| 4,259,949 | 4/1981 | Axelsson | 128/77 |
| 4,323,060 | 4/1982 | Pecheux | 128/84 R |
| 4,534,555 | 8/1985 | McGowen | 128/75 |
| 4,551,872 | 11/1985 | Reed | 5/445 |
| 4,649,907 | 3/1987 | Whitehead | 128/84 C |
| 4,753,228 | 6/1988 | Selner | 128/80 R |

FOREIGN PATENT DOCUMENTS

| | | | |
|---|---|---|---|
| 920448 | 4/1947 | France | 128/84 C |

*Primary Examiner*—Robert A. Hafer
*Assistant Examiner*—Michael A. Brown
*Attorney, Agent, or Firm*—Chilton, Alix & Van Kirk

[57] ABSTRACT

A limb holding device designed to be attached to an operating table to immobilize a patient's arm or leg during arthroscopic surgery or the like. It provides for distraction of the hip joint or other joint being worked on, and also provides for reduction and maintenance of position of fractures of the arm or leg. The device includes a pair of vertical upright supports braced by an adjustable connecting bar, and a fork-like member has a canvas or plastic cradle stretched between its two tines, a plurality of straps to immobilize the patient's limb on the cradle, a padded shoe-like or plate-like device to hold the foot firmly, and a handle to facilitate manipulation of the limb and to place the proper traction forces thereon. A tensiometer is integrated into the fork-like member to allow direct and accurate indication of the traction force being placed on the limb. Once the desired position of the limb and joint is achieved, the various adjustable clamps and stop nuts may be secured to lock the device in that position during surgery.

6 Claims, 1 Drawing Sheet

SURGICAL LIMB SUPPORTING APPARATUS WITH TENSION MEASURING DEVICE

This application is a continuation-in-part of application Ser. No. 183,636 filed Apr. 19, 1988 now abandoned.

CONTINUING APPLICATION DATA

1. Field of the Invention

This invention relates to a limb holding device designed to immobilize a hip during arthroscopic surgery, and it is also adaptable to most types of leg surgery, as well as for surgery on the arm or shoulder. To function properly in the surgical environment, a limb supporting device must provide firm immobilization of the upper or lower extremity involved in the surgery, allow for the extremity to be moved in any direction and then be firmly fixed in place, and allow the joint involved to be distracted to allow insertion of surgical instruments or the like.

2. Description of the Prior Art

Prior art devices have been cumbersome to use and ineffective in providing a universal range of movement of the limb being treated such that the surgeon may most efficiently and effectively treat the patient.

Examples of such prior art devices include U.S. Pat. No. 3,087,489 issued to H. Gilbert et al on Apr. 30 1963, entitled "Universal Orthopedic Traction and Holding Device" and U.S. Pat. No. 3,840,166 issued to Tammy et al Nov. 26, 1974, entitled "Fracture Reduction Device". Both of these patents show cumbersome devices which impede a surgeon's treatment of a limb by causing him to work around the hardware of the apparatus, wherein a portion of the limb being treated may be inaccessible without shifting the position of either the patient or the apparatus, or causing the surgeon to lean completely across the patient's body to treat the limb. Such inconveniencing of and acrobatics by the surgeon are precluded by the limb supporting device of the subject invention.

BRIEF SUMMARY OF THE INVENTION

The invention consists of two L-shaped or straight poles designed to be secured to one end of a standard operating table, with the horizontal or vertical portions of the poles attached to the table sides, and the upright portions extending vertically upward above the table top. The upright portions for the poles are interconnected by an adjustable connecting bar, to which is secured by a universally adjustable clamp a fork-like limb holding member. The two tines of the fork-like member are formed of two telescoping elements, the outer, female portions of the fork being interconnected by an outer base member which includes a post for a foot holder, and the inner, male portions of the fork being interconnected by an inner base member. The open ends of the tines of the fork are interconnected by a canvas or plastic material to comfortably cradle the patient's arm or leg, and attached along the length of the cradle material are a plurality of strap means for immobilizing and securing the limb. The handle end of the fork is a threaded shaft terminating in a T-handle. Located along the threaded portion of the handle are a threaded handle and associated stop nuts to allow positional and tensional adjustments of the fork member and its cradled limb. A tension measuring device is placed between the inner and outer base members of the fork to indicate directly the tension being applied to the patient's limb. To provide further adaptability of the device, a foot attachment device may be attached to the foot holder post attached to the outer base of the limb holding fork. The foot plate or shoe includes a plurality of straps and cuffs to allow firm attachment of the foot to the post to facilitate rotation, flexion, extension abduction or adduction of the lower extremity.

DETAILED DESCRIPTION OF THE PREFERRED EMBODIMENT

Figure 1:
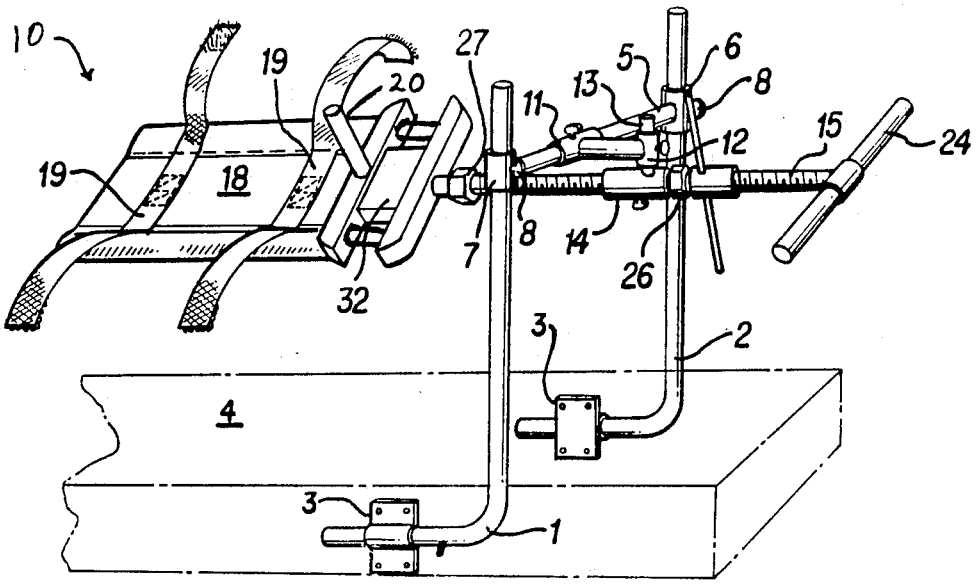
FIG. 1 is a perspective view of the limb supporting device of the invention shown secured to a standard operating table (illustrated in phantom).

Referring now to FIG. 1, the limb supporting device of the subject invention is shown attached to the end of a standard operating table, and positioned for use. The two main L-shaped or straight support bars 1 and 2 are shown with their horizontal or vertical portions secured by clamps 3 to opposite sides of one end of the table 4. The upright portions of bars 1 and 2 extend vertically upward above the surface of table 4. These upright portions are interconnected by connecting bar 5, which includes at either end, an adjustable clamping means 5, 7. As roundsection tubing or solid rods are utilized throughout in the construction of this invention, this clamp may take the form of a cylindrical sleeve welded or otherwise attached to the end of connecting bar 5, slid over the top end of the upright portions of bars 1 and 2, and secured by means of a thumbscrew or handle 8 threaded through the sleeve and frictionally engaging the upright bar.

Centrally attached on connecting bar 5 is a two-part clamping apparatus which allows universal movement of limb-supporting fork member 10 attached thereto. This clamping apparatus includes a first sleeve-and-thumbscrew clamp 11 which is secured to connecting bar 5, and second sleeve-and-thumbscrew clamp 12 which is secured to short post 13, and a third sleeve-and-thumbscrew clamp 14 which is secured to the threaded shaft 15 for the fork handle. This elaborate clamping arrangement allows ease of removal and replacement of the entire limb-supporting fork member 10 without disassembly of the entire apparatus. Simply loosening clamp 12 allows removal of post 13, clamp 14 and the entire fork member 10.

Figure 3:
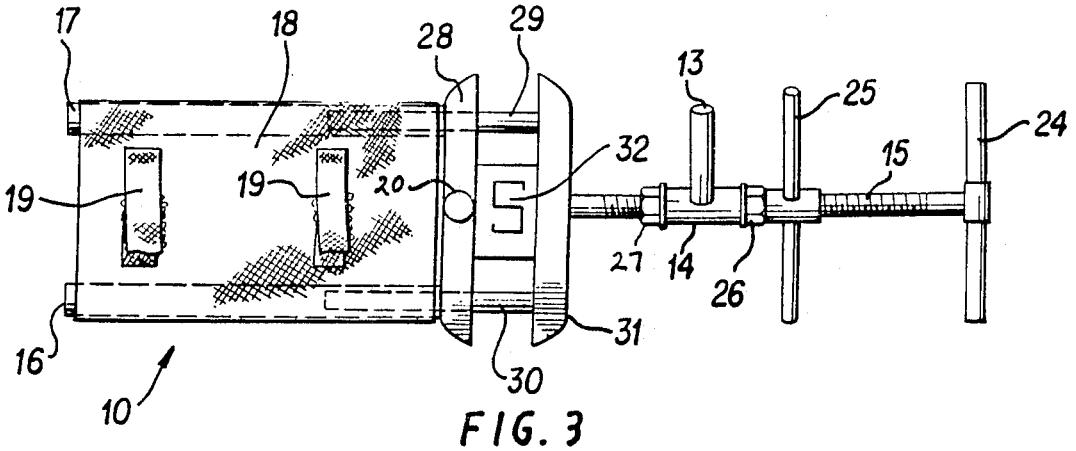
FIG. 3 is a top plan view of the limb supporting fork member removed from its vertical and horizontal support structure for clarity, and including the tension measuring device.

Referring now to FIG. 3, fork member 10 is comprised of female tines 16 and 17 which are interconnected by outer base member 28 and male tines 29 and 30 which are interconnected by inner base member 31. Mounted between inner and outer base members 31 and 28 is a tension measuring device 32. Tensiometer 32 may be a mechanical or electronic unit, one of many devices available in the marketplace, so long as it is capable of providing an accurate readout of the tension being placed upon the patient's limb by the limb supporting device.

Sewn or otherwise attached around and between the female tines 16 and 17 of fork member 10 is a canvas or plastic material 18 which serves to cradle and support the limb of the patient which is to be immobilized. To secure the limb to the cradle, a plurality of straps or cuffs 19 are sewn or otherwise attached along the length of cradle material 18.

Figure 2:
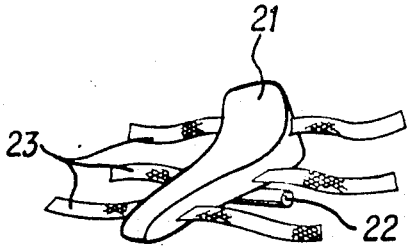
FIG. 2 is a perspective view of the foot plate which may be added to the limb supporting device to aid positioning of a leg.

To further facilitate positioning and securement of a leg to the device, a post 20 is shown welded or otherwise attached centrally to outer base member 28 between fork tines 16 and 17, and extending perpendicular to the plane defined by the tines 16 and 17. To this post 20 may be attached foot plate 21 (FIG. 2) by means of sleeve 22. Foot plate 21 includes a plurality of straps 23 which serve to secure a patient's foot to the plate, thus providing more positive positioning and/or movement of a patient's leg when immobilized using the present invention.

The handle portion of fork member 10 (FIGS. 1 and 3) includes an elongate threaded shaft 15 welded or otherwise secured centrally to inner base member 31 between fork tines 29 and 30, and extending opposite to the direction of the tines parallel thereto, and in the same plane. Shaft 15 terminates in a short, T-shaped handle 24 which is rigidly secured to fork member 10 for ease of rotational manipulation of fork 10 and cradle 18 while supporting a limb. Carried upon threaded shaft 15 are a tension adjusting handle 25 and an associated pair of stop nuts 26 and 27, one nut mounted on either side of sleeve clamp 14. These elements allow for fine adjustment of the traction force exerted on the patient's limb, moving fork member 10 one thread-width at a time for every full revolution of windlass handle 25. Since the outer or female fork tines 16 and 17 are freely slidable over the inner or male tines 29 and 30, the force place upon the patient's limb will be directly readable on tensiometer 32.

In use, the entire limb supporting device is attached to an operating table 4 as shown in FIG. 1. The patient is positioned on the table 4 in such a manner that the desired limb rests on cradle material 18. The vertical height, angle of inclination and longitudinal positions of the cradle may be adjusted through sleeve clamps 6, 7, 11, 12 and 14. Once the desired position is achieved, the patient's limb is immobilized by securement of straps 19 about the limb. Additionally, in the case of leg or hip surgery, foot plate 21 (FIG. 2) may be attached to fork member 10 by locating sleeve 22 on post 20, and securing the patient's foot to foot plate 21 by means of straps 23.

Once the limb has been immobilized, coarse adjustments in the traction forces placed on the limb may be made by pushing, pulling or rotating T-handle 24. Final, fine adjustments in the traction forces are achieved through the use of windlass handle 25 and associated stop nuts 26 and 27, with the stop nuts used to rigidly secure the entire device in the position required for surgery. Tensiometer 32 provides a direct and accurate readout of the traction force being applied to the limb to aid in accurate adjustment by the surgeon. It is obvious from the foregoing description of the use of this device that any minute positional corrections which might become necessary during the course of surgery may be easily achieved by loosening the appropriate clamp or stop nut, making the correction, and securing the device in its new position.

This detailed description of the preferred embodiment of the present invention and the specific apparatus described herein may of course be modified or changed in the design, construction or materials thereof without departing from the spirit and scope of this invention, which is limited only by the appended claims.

We claim:

1. A limb supporting apparatus adaptable for use during surgery and mountable to a standard operating table having an end portion with opposed sides comprising:

a pair of support bars each having end portions;

clamp means for mounting said support bars to opposed sides of the operating table so that said end portions of said support bars extend generally vertically upward above the table;

connecting bar means secured between said end portions;

limb supporting means secured to said connecting bar means comprising:

a pair of inner tines attached to an inner base means for interconnecting said inner tines;

a pair of outer tines mounted in telescopic relationship to said inner tines and attached to an outer base means for interconnecting said outer tines;

limb support mounting means connecting said inner base means for mounting said limb supporting means to said connecting bar means; and tension indicating means engagable with said inner and outer base means for directly indicating the tension between said inner and outer base means.

2. The limb supporting apparatus of claim 1 wherein said tension indicating means comprises a mechanical device having an analog gauge readout.

3. The limb supporting apparatus of claim 1 wherein said tension indicating means comprises an electronic device having a digital readout.

4. The limb supporting apparatus of claim 1 further comprising tension adjustment means connecting said inner base means for variably adjusting the tension between said outer and inner base means by varying the distance of said inner base means from said connecting bar means.

5. The limb supporting apparatus of claim 4 wherein said limb support mounting means comprises an elongated connecting rod and said tension adjustment means comprises an angularly rotatable crank means for longitudinally displacing said connector rod.

6. The limb supporting apparatus of claim 1 further comprising limb securement means for securing a limb to said outer tines.

* * * * *